US006531669B1

(12) United States Patent
Miller et al.

(10) Patent No.: US 6,531,669 B1
(45) Date of Patent: Mar. 11, 2003

(54) METHOD AND SYSTEM FOR ILLUMINATING A MECHANICAL ROTARY PUSH-BUTTON SWITCH

(75) Inventors: Robert E. Miller, Cedar Rapids, IA (US); Jason Bunge, O'Fallon, MO (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/847,783

(22) Filed: May 2, 2001

(51) Int. Cl.[7] ..... H01H 9/00
(52) U.S. Cl. ..... 200/313; 200/314; 200/316
(58) Field of Search ..... 200/313, 310, 200/314, 316, 341, 318.2; 362/470, 471, 26, 95

(56) References Cited

U.S. PATENT DOCUMENTS 5,888,008 A * 3/1999 Obersteller et al. ..... 401/119

FOREIGN PATENT DOCUMENTS

| | | | |
|---|---|---|---|
| DE | 3836625 | * | 5/1989 |
| EP | 605324 | * | 7/1994 |

* cited by examiner

*Primary Examiner*—Michael Friedhofer
*Assistant Examiner*—Lisa Klaus
(74) *Attorney, Agent, or Firm*—Nathan O. Jensen; Kyle Eppele

(57) ABSTRACT

A system and method for illuminating a push-button type avionics mechanical-to-electrical rotary switch, which includes an optical fiber extending through a hollow shaft in said switch, and where said optical fiber provides illumination of the push button when depressed.

19 Claims, 2 Drawing Sheets

METHOD AND SYSTEM FOR ILLUMINATING A MECHANICAL ROTARY PUSH-BUTTON SWITCH

FIELD OF THE INVENTION

The present invention generally relates to aviation electronics, and more particularly relates to cockpit controls for avionics equipment, and even more particularly relates to methods and systems for illuminating mechanical rotary push-button switches in an aircraft cockpit.

BACKGROUND OF THE INVENTION

In recent years, the Federal Aviation Administration (FAA) has begun requiring that all mechanical rotary switches which have push buttons be lighted for easier viewing in low light and other conditions. Avionics engineers are constantly striving for improvements which either reduce the weight of an airborne device, reduce its cost or power consumption, or increase its reliability. Often, avionics engineers must make design trade-offs among these often conflicting goals. One such example is the prior art mechanical-to-electrical rotary switch which is lighted via a lamp disposed on the panel end of the switch rotary shaft. Typically, this lamp is powered by a wire or an integral electrical trace which is formed into the switch. This lamp is used to illuminate the entire panel end of the button. While these illuminated lamps have been used extensively in the past, they do have some drawbacks. First of all, they often have leakage problems which result in bright light being emitted in the cockpit in the gaps around the periphery of the button. They also often have reliability problems if the lamps are disposed near the buttons where they may have inadequate heat transfer structure. This results in either hot buttons or a hot environment about the lamp, which can lead to lamp failures. Alternatively, these switches can be made to be free from leakage and/or more reliable, but then often a relatively high cost and with more weight.

Consequently, there exists a need for improved methods and systems for illuminating, in an efficient manner, a mechanical-to-electrical rotary switch which has a push button.

SUMMARY OF THE INVENTION

It is an object of the present invention to provide a system and method for illuminating a mechanical-to-electrical rotary switch in an efficient manner.

It is a feature of the present invention to utilize a hollow switch rotating shaft.

It is another feature of the present invention to include a fiber optic cable disposed within said hollow shaft.

It is another feature of the present invention to power the illumination of the switch from an avionics line replaceable unit (LRU), which is coupled to and receives signals from the rotary switch.

It is an advantage of the present invention to achieve improved efficiency in illuminating rotary switches.

It is another advantage of the present invention to visually indicate a loss of power in the avionics LRU which receives signals from the switch.

It is another advantage of the present invention to reduce the amount of leakage of unwanted light into the cockpit.

The present invention is an apparatus and method for illuminating a mechanical-to-electrical rotary switch, which is designed to satisfy the aforementioned needs, provide the previously stated objects, include the above-listed features, and achieve the already articulated advantages. The present invention is carried out in a "leakage-less" manner in a sense that the light leakage about the periphery of the button has been greatly reduced.

Accordingly, the present invention is a system and method including a mechanical-to-electrical rotary switch, having a hollow switch shaft with an optical fiber disposed therein.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
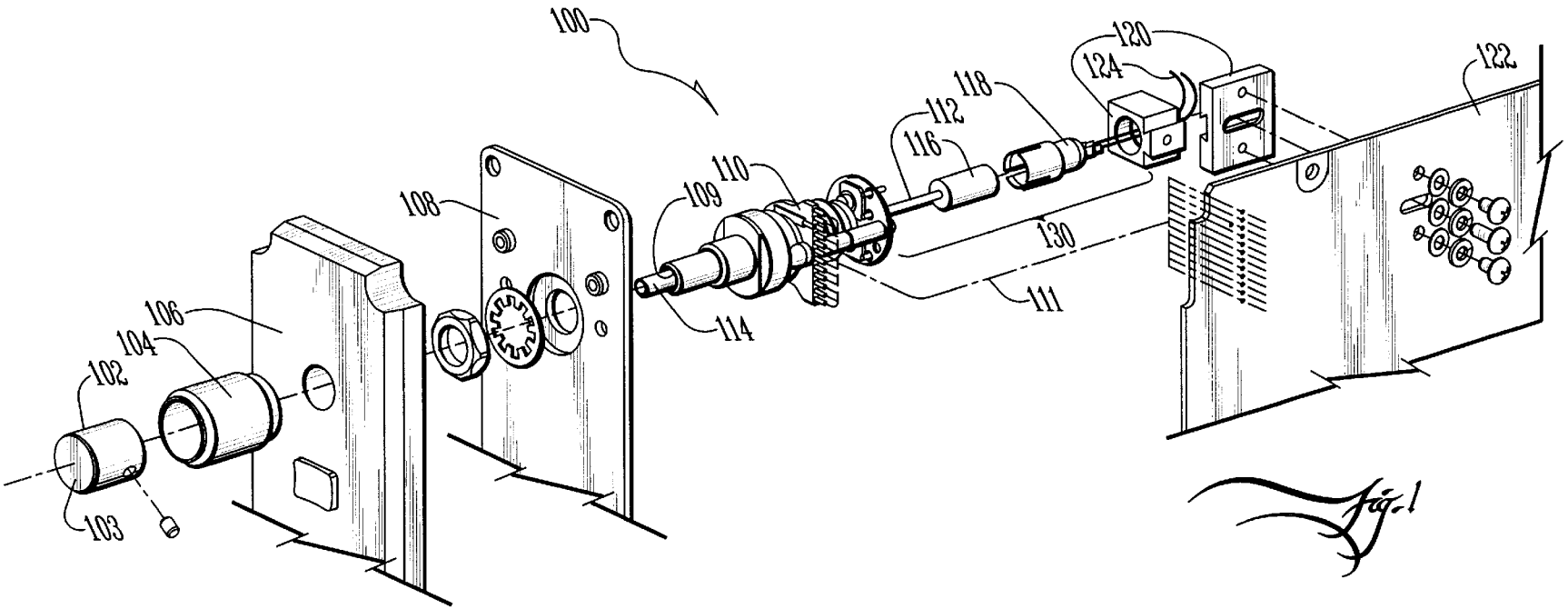
FIG. 1 is an exploded perspective view of a switch of the present invention.

Now referring to the drawings wherein like numerals refer to like matter throughout, and more specifically referring to FIG. 1, there is shown an exploded view of the system of the present invention generally designated 100, including an illuminated push button 102, which may be any type of well-known prior art push button. In a preferred embodiment, illuminated push button 102 may be a transparent or translucent material which is designed, adapted, or configured to act as a lens with a predetermined button focal point located relatively close to an end of a push button channel 202 (FIG. 2) therein. Illuminated push button 102 is shown as being disposed in a rotary knob 104. This relationship of a translatable push button within a rotary knob is well known in the art. Visible panel 106 represents the outer surface of a control panel or avionics line replaceable unit 130. The avionics line replaceable unit 130 can be an electronic instrument such as, but not limited to: an avionics display, control head, weather radar receiver, radio, altimeter, flight control computer, navigation instrument, etc.

Avionics line replaceable unit 130 can be any type of avionics device, but in a preferred embodiment, it would be an avionics line replaceable unit 130 which has been certified by the Federal Aviation Administration (FAA) or determined to be in compliance with FAA regulations or other requirements. Throughout this discussion, the terms "certified", "verified", or "determined", or variations of these terms, with respect to the FAA or agency of the U.S. government which regulates air safety, shall mean any certification, verification, or determination made by such agency irrespective of whether its official designation is the same. Any determination by such agency which follows any inquiry or inspection by said agency, shall be construed as being "certified", "verified", or "determined" by such agency.

Backplate 108 is a mounting plate adapted to cooperate with visible panel 106 and may be a separate plate or a portion of a case of avionics line replaceable unit 130.

FIG. 1 also shows mechanical-to-electrical rotary switch assembly 110, which is a switch capable of rotary adjustment and is very similar to switches which are well known in the art, except that mechanical-to-electrical rotary switch assembly 110 has a centrally disposed channel 109 running therethrough (FIG. 1). This centrally disposed channel is sized and configured to receive therein fiber optic cable 112. Fiber optic cable 112 may be any type of fiber cable which is suitable for the particular needs. In a preferred embodiment, light projection end 114 of fiber optic cable 112 may be designed, adapted, or configured to act as a lens. Fiber optic cable 112 receives light from light source connector assembly 118, which can be an incandescent lamp, a diode, or any other suitable light source known in the art. A collar 116 is used to dispose the fiber optic cable 112 to the light source connector assembly 118. Wires 124 connect the light source 118 to the avionics printed circuit board 122. Wires 124 are preferably coupled to the same power source which provides power to avionics line replaceable unit 130. If this power source fails, then the light on viewing surface 103 of illuminated push button 102 is extinguished, and the pilot is notified immediately of the power failure. Light source mounting assembly 120 provides mechanical support and connection with avionics printed circuit board 122. Avionics printed circuit board 122 is coupled to mechanical-to-electrical rotary switch assembly 110 via switch wires 111. Light source mounting assembly 120 is preferably designed to provide predetermined levels of thermal conductivity to remove heat generated by the light source 118 to a remote location where it can be safely dissipated, thereby removing excess heat from the proximity about light source 118. This reduction in heat can have an improvement in the lifetime of the light source 116. The entire contents of FIG. 1 could be a portion of an avionics line replaceable unit 130.

Avionics printed circuit board 122 is shown as a single printed circuit board for simplicity; it is intended to represent either a single printed circuit board, a plurality of printed circuit boards, or any electronic hardware used in an avionics line replaceable unit 130.

Figure 2:
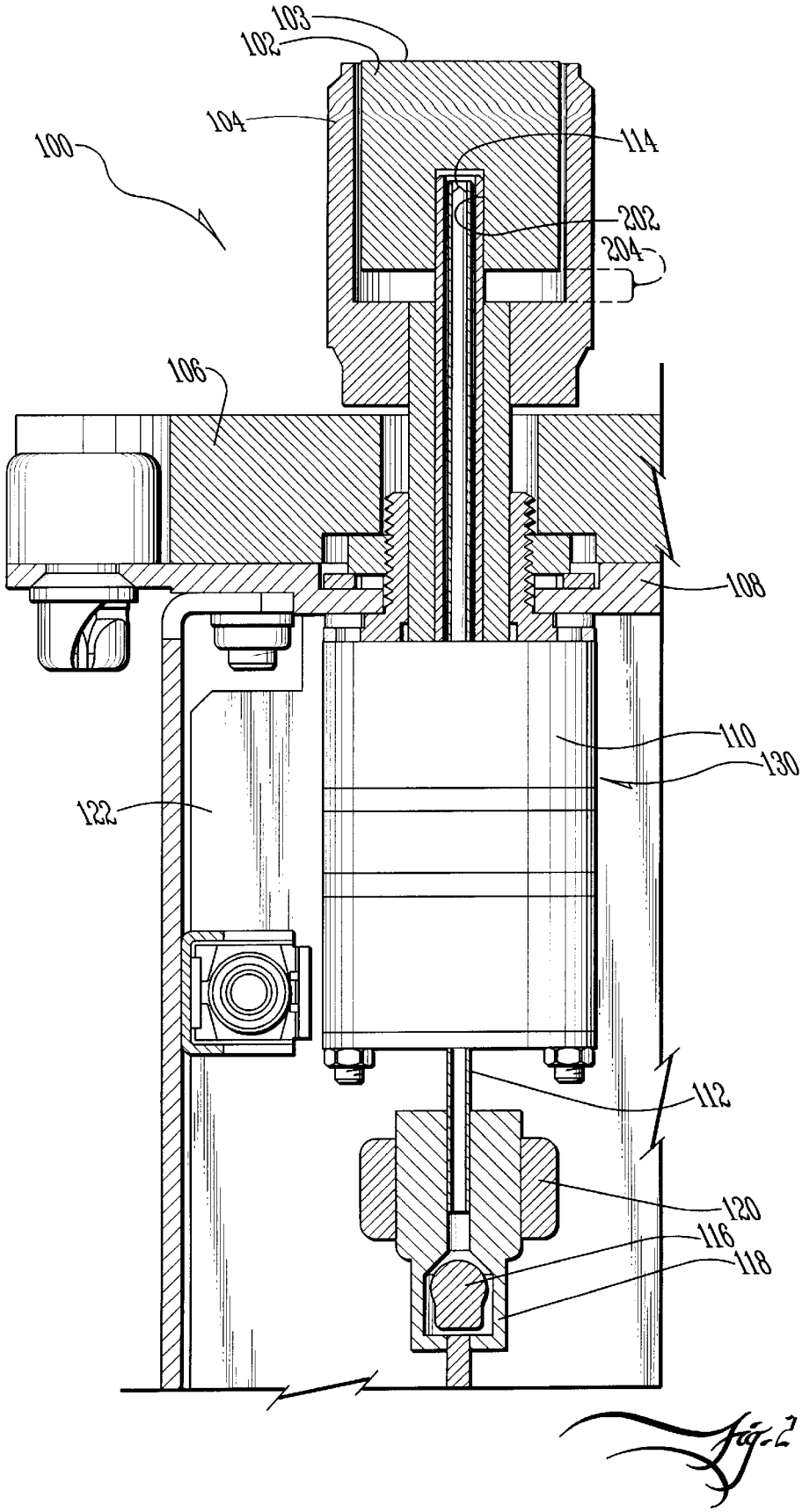
FIG. 2 is a partial cross-sectional view of the present invention.

A more detailed understanding of the present invention can be achieved by now referring to FIG. 2, which shows a partial cross-sectional view of portions of one embodiment of the present invention. Mechanical-to-electrical rotary switch assembly 110 is not shown in a cross-sectional view. The details of mechanical-to-electrical rotary switch assembly 110 are readily determinable, with the aid of the present disclosure, by a person skilled in the art of rotary switch design. A push button channel 202 is shown disposed in illuminated push button 102. In this FIG. 2, illuminated push button 102 is shown in its non-depressed state, where it may be pushed to a depressed position which exceeds further into rotary knob 104 as indicated by the travel clearance 204.

In a preferred embodiment of the present invention, illuminated push button 102, light projection end 114, and the distance of travel of illuminated push button 102 with respect to rotary knob 104, can be adapted and configured to provide for variable light intensity at viewing surface 103 of illuminated push button 102. As mentioned above, light projection end 114 may act as a lens with a predetermined focal length, which when cooperating with illuminated push button 102, which is adapted to act as a lens with a predetermined focal length, can result in variable light intensity at viewing surface 103, depending upon whether the illuminated push button 102 is depressed into rotary knob 104. The light source 118 would preferably be constantly providing light and, therefore, there would be no need to adjust the intensity of the light output by light source 118 to accomplish a variable light intensity at viewing surface 103.

In operation, the apparatus and method of the present invention, as described in FIGS. 1 and 2, could function as follows: the avionics line replaceable unit 130 is disposed in a panel (not shown, but well known in the art) in the cockpit of an aircraft; a pilot or other flight deck personnel could look at the avionics line replaceable unit 130 and see the viewing surface 103 of illuminated push button 102 illuminated. The pilot could twist rotary knob 104 to make a change in a setting of avionics line replaceable unit 130. The pilot could depress illuminated push button 102 with respect to rotary knob 104 to send another signal to avionics line replaceable unit 130. In response to this depressing action, the amount of illumination could be increased from an earlier lower level of illumination. The design of the present invention with the push button light channel 202 disposed within illuminated push button 102 results in a much more controlled illumination of the viewing surface 103 and greatly reduces any leakage of light which would pass directly from a light source through a gap between the button and a housing and then into the eyes of the pilot.

Throughout this description, reference is made to an avionics line replaceable unit and to pilots, etc., because it is believed that the beneficial aspects of the present invention would be most readily apparent when used in connection with avionics equipment and with pilots; however, it should be understood that the present invention is not intended to be limited to pilots and avionics applications and should be hereby construed to include other non-aviation applications as well, such as, but not limited to, automotive dashboards and drivers.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. An apparatus comprising:

a mounting assembly;

a light source coupled to said mounting assembly;

a fiber optic cable coupled to said light source;

a mechanical-to-electrical rotary switch assembly having a central channel therein;

said fiber optic cable at least partially disposed in said central channel;

said fiber optic cable having a light projection end, which is opposite of a light source end adjacent to said light source;

a rotary knob;

said fiber optic cable at least partially disposed in said rotary knob;

an illuminated push button having a viewing surface thereon;

said illuminated push button being coupled to and partially disposed within said rotary knob when said illuminated push button is deployed in one of a plurality of spatial configurations with respect to said rotary knob; and, said illuminated push button having a push button channel therein containing said light projection end of said fiber optic cable.

2. An apparatus of claim 1 wherein:

said rotary knob is disposed on a control panel.

3. An apparatus of claim 2 wherein said control panel is in an automobile.

4. An apparatus of claim 1 wherein said mechanical-to-electrical rotary switch assembly is electrically coupled to an avionics line replaceable unit.

5. An apparatus of claim 1 wherein said illuminated push button is adapted and configured to translate within said rotary knob.

6. An apparatus of claim 1 wherein said mechanical-to-electrical rotary switch assembly is disposed between said light source and said rotary knob.

7. An apparatus of claim 4 wherein said light source is continuously operating while said avionics line replaceable unit is in an operational state.

8. An apparatus of claim 1 wherein said light source is an incandescent lamp.

9. An apparatus of claim 7 wherein said avionics line replaceable unit is powered by a power supply which also provides power to said light source.

10. An apparatus of claim 1 wherein said combination of said illuminated push button, said rotary knob, and said light projection end are adapted and configured so that a brightness level of illumination of said illuminated push button is changed when said illuminated push button is caused to move between a plurality of predetermined orientations with respect to said rotary knob.

11. An apparatus comprising:

means for providing a light from a first location inside a box;

a button disposed in a rotary knob;

means for changing an electrical signal in response to twisting said rotary knob; and, means for transmitting light from said first location, through said means for changing and on to a second location.

12. An apparatus of claim 11 wherein said means for providing a light is an incandescent lamp.

13. An apparatus of claim 11 wherein said means for transmitting is an optical fiber.

14. An apparatus of claim 13 wherein said means for changing is a rotary switch having a central channel disposed therethrough.

15. An apparatus of claim 14 wherein said optical fiber extends through said rotary knob and terminates in a cavity within said button.

16. An illumination apparatus, comprising:

a light source;

a rotary knob;

a push button coupled to and partially disposed within the rotary knob when the push button is deployed in one of a plurality of spatial configurations with respect to the rotary knob; and a fiber optic cable having a light source end adjacent the light source, the fiber optic cable also having a light projection end that is disposed within the push button to illuminate the push button.

17. The apparatus of claim 16, wherein the push button, the rotary knob, and the light projection end of the fiber optic cable are adapted and configured such that a brightness level of illumination of the push button is varied when the push button is caused to move between a plurality of predetermined orientations with respect to the rotary knob.

18. The apparatus of claim 16, further comprising a switch that changes an electrical signal in response to movement of the rotary knob.

19. The apparatus of claim 18, wherein the fiber optic cable passes through the switch.

* * * * *